US011457778B2

(12) United States Patent
Yang

(10) Patent No.: US 11,457,778 B2
(45) Date of Patent: Oct. 4, 2022

(54) MULTIFUNCTIONAL URINAL FOR CHILDREN

(71) Applicant: XIAMEN BABY PRETTY PRODUCTS CO., LTD., Xiamen (CN)

(72) Inventor: Jianbo Yang, Xiamen (CN)

(73) Assignee: XIAMEN BABY PRETTY PRODUCTS CO., LTD., Xiamen (CN)

( * ) Notice: Subject to any disclaimer, the term of this patent is extended or adjusted under 35 U.S.C. 154(b) by 0 days.

(21) Appl. No.: 17/244,984

(22) Filed: Apr. 30, 2021

(65) Prior Publication Data

US 2022/0211228 A1 Jul. 7, 2022

(30) Foreign Application Priority Data

Jan. 6, 2021 (CN) ..... 202120025686.5

(51) Int. Cl.
*A47K 11/12* (2006.01)

(52) U.S. Cl.
CPC ..... *A47K 11/12* (2013.01)

(58) Field of Classification Search
CPC ..... A47K 11/12
USPC ..... 4/144.1, 144.2, 144.3, 144.4, 449, 301; 600/573; 604/327
See application file for complete search history.

(56) References Cited

U.S. PATENT DOCUMENTS 2,687,534 A * 8/1954 Johnson ..... A61G 9/006 4/144.1
3,419,913 A * 1/1969 Crosby ..... A61G 9/006 4/144.2
3,992,727 A * 11/1976 Elkins ..... E03D 7/00 4/144.1
4,309,779 A * 1/1982 Knight ..... A61G 9/006 4/144.1
4,937,889 A * 7/1990 Strickland ..... A61F 5/4556 4/144.2
5,148,553 A * 9/1992 Jermann ..... A47K 11/12 4/144.1
5,810,201 A * 9/1998 Besse ..... A47K 5/1217 222/39
6,393,627 B1 * 5/2002 Avila ..... A47K 11/035 4/449
7,086,097 B2 * 8/2006 Shin ..... A47K 11/12 4/144.1
9,730,563 B1 * 8/2017 Giametta ..... B60R 15/04
10,179,988 B2 * 1/2019 Lor ..... H04W 4/80
11,033,158 B1 * 6/2021 Marshall ..... G09B 19/00
(Continued)

*Primary Examiner* — Lori L Baker

(74) *Attorney, Agent, or Firm* — Bayramoglu Law Offices LLC

(57) ABSTRACT

A multifunctional urinal for children includes a base, a pan seat and a urinal pan. The pan seat is set on the base and can be lifted or lowered. The periphery of the base is provided with a supporting edge. The bottom surface of the pan seat can be located on the supporting edge. The front surface of the pan seat is provided with a urinal pan opening, and the urinal pan is detachably set on the opening. The pan seat can be lifted and lowered on the base. When used by children of different heights, the pan seat has an adjustable height to provide a more convenient and suitable urinal for children, while the urinal pan and the urinal pan opening are detachably connected, so that the urinal pan can be disassembled to pour out the urine after a child finishes urinating.

19 Claims, 7 Drawing Sheets

(56) References Cited

U.S. PATENT DOCUMENTS

| | | | | |
|---|---|---|---|---|
| 11,103,112 | B1 * | 8/2021 | Jasmin | A47K 11/02 |
| 2002/0020006 | A1 * | 2/2002 | Mason | A47K 11/12 4/144.1 |
| 2005/0251902 | A1 * | 11/2005 | Shin | A47K 11/12 4/144.1 |
| 2008/0052810 | A1 * | 3/2008 | Zeeb | A47K 11/12 4/144.1 |
| 2013/0212792 | A1 * | 8/2013 | Osborne | A47K 11/12 4/144.1 |
| 2014/0033414 | A1 * | 2/2014 | Kolter | A47K 11/12 4/144.3 |
| 2015/0000027 | A1 * | 1/2015 | Hughes | A47K 11/00 4/479 |
| 2016/0060856 | A1 * | 3/2016 | McIntyre | E03D 11/12 4/311 |
| 2017/0073954 | A1 * | 3/2017 | Lor | E03D 1/003 |
| 2017/0164795 | A1 * | 6/2017 | Le | A61F 5/451 |
| 2020/0154960 | A1 * | 5/2020 | Le | A47K 11/12 |
| 2020/0390627 | A1 * | 12/2020 | Hall | A61G 7/1017 |

* cited by examiner

MULTIFUNCTIONAL URINAL FOR CHILDREN

CROSS REFERENCE TO THE RELATED APPLICATION

This application is based upon and claims priority to Chinese Patent Application No. 202120025686.5, filed on Jan. 6, 2021, the disclosure of which is incorporated herein by reference in its entirety.

TECHNICAL FIELD

The present invention relates to the field of child products, in particular to a multifunctional urinal for children.

BACKGROUND

A urinal for children is different from one for adults and it is designed specially according to the physical characteristics of young boys. The urinal for children can be fixed on the wall or optionally placed on the floor of the toilet. With the development of technology, styles of the urinal for children are more diversified. However, most of the urinals for children on the market are fixed, without adjustable height. Due to the different heights of children at different ages, the urinal for children cannot satisfy the usage requirement of children in different heights, which restricts universal application of the urinal for children of all sizes.

SUMMARY

The present invention provides a multifunctional urinal for children to solve the above-mentioned problems in prior art.

The present invention is achieved by the following technical solutions:

A multifunctional urinal for children includes a base, a pan seat and a urinal pan. The pan seat is set on the base and can be lifted or lowered. The periphery of the base is provided with a supporting edge. The bottom surface of the pan seat can be located on the supporting edge. The front surface of the pan seat is provided with a urinal pan opening. The urinal pan is detachably set on the urinal pan opening.

Further, the left end and the right end of the base are provided with post guiding slots. The left side and right side of the base are provided with notches communicating with the corresponding post guiding slots. The lower left portion and the lower right portion of the inner side of the pan seat are both provided with a connecting piece. One side of the connecting piece is provided with a guide post. The connecting piece corresponds to a notch and fits with the corresponding notch. The connecting piece is located in the corresponding notch. The guide post corresponds to a post guiding slot and fits with the corresponding post guiding slot. The guide post is located in the corresponding post guiding slot. The top surface of the base is provided with an elastic pulling piece. The front end of the pulling piece is provided with a clamping plate. The lower middle portion of the inner side of the pan seat is provided with a plurality of clamping slots that the clamping plate can be inserted into and set at upper and lower intervals.

Furthermore, the top surface of the base is provided with a T-shaped slot. The pulling piece is T-shaped and located in the T-shaped slot. The middle portion of the transverse rear end surface of the pulling piece is provided with a spring placement slot, and a spring is set between the spring placement slot and the middle portion of the transverse rear side of the T-shaped slot. The clamping plate is set at the front end of the pulling piece, and a convex part is set on the vertical top surface of the pulling piece. A groove is set on the top surface of the convex part. A T-shaped fixing plate is located on the top surface of the pulling piece, and the bottom surface of the fixing plate is provided with a plurality of hooks. The T-shaped slot is provided with a plurality of hook slots corresponding to the hooks, and each hook corresponds to a hook slot and can be hooked into the hook slot. A movable slot is set on the vertical top surface of the fixing plate. The convex part is located in the movable slot, and the length of the convex part is less than the length of the movable slot.

Further, the lower middle portion of the inner side of the pan seat is provided with a guide part. The middle portion of the front side of the base is provided with a guide slot matched with the guide part. The top of the guide slot is connected to the front end of the T-shaped slot. The plurality of clamping slots are located on the guide part. The clamping plate is matched with the guide slot and extends into the guide slot.

Further, the height of the guide part and the height of the guide post are equal. A limit plate is provided on the inner side of the pan sea. The bottom surface of the limit plate is located on the top surface of the guide part and the guide post.

Further, the left end and the right end of the transverse part of the pulling piece are both provided with limit slots. Two limit pieces are set on the transverse rear side of the T-shaped slot, and each limit piece fits with a limit slot. Both the left end and the right end of the transverse part of the pulling piece are provided with extending parts. Limit parts are set both on the lower left portion and the lower right portion of the inner side of the pan seat, and the limit part is set on the front side of the corresponding connecting piece. A guide channel is formed between the limit part and the corresponding connecting piece. Two openings are set on the bottom surface of the pan seat, and each opening corresponds to a guide channel. The limit part is provided with a plurality of extending part slots set at upper and lower intervals, and each extending part corresponds to a limit part. The extending part can be located in the extending part slot.

Further, the urinal pan is set obliquely backward and downward, and a clamping edge is set on the front end of the urinal pan. The urinal pan opening is provided with a clamping edge slot for receiving the clamping edge, and a plurality of slots are set on the clamping edge slot. A plurality of insert pieces are set on the rear end of the clamping edge. Each insert piece corresponds to a clamping edge slot and is inserted into the corresponding clamping edge slot. A hand slot is set on the middle portion of the top surface of the urinal pan opening.

Further, an electrically connected trigger switch and a music box are provided within the pan seat. The pan seat is provided with an elastic button, and the elastic button can be located on the trigger switch.

Further, a suspension plate is provided in the middle of the rear end of the pan seat, and a suspension hole is set on the suspension plate.

According to the above description of the present invention, compared with the prior art, the present invention has following advantages: the present invention has novel structure and ingenious design. The pan seat on the base can be lifted and lowered. When used by children of different heights, the pan seat having an adjustable height can provide a more convenient and suitable urinal for children. Moreover, the urinal pan and the opening are detachably connected, so that the urinal pan can be removed to pour out the urine after a child finishes urinating.

DETAILED DESCRIPTION OF THE EMBODIMENT

Figure 1:
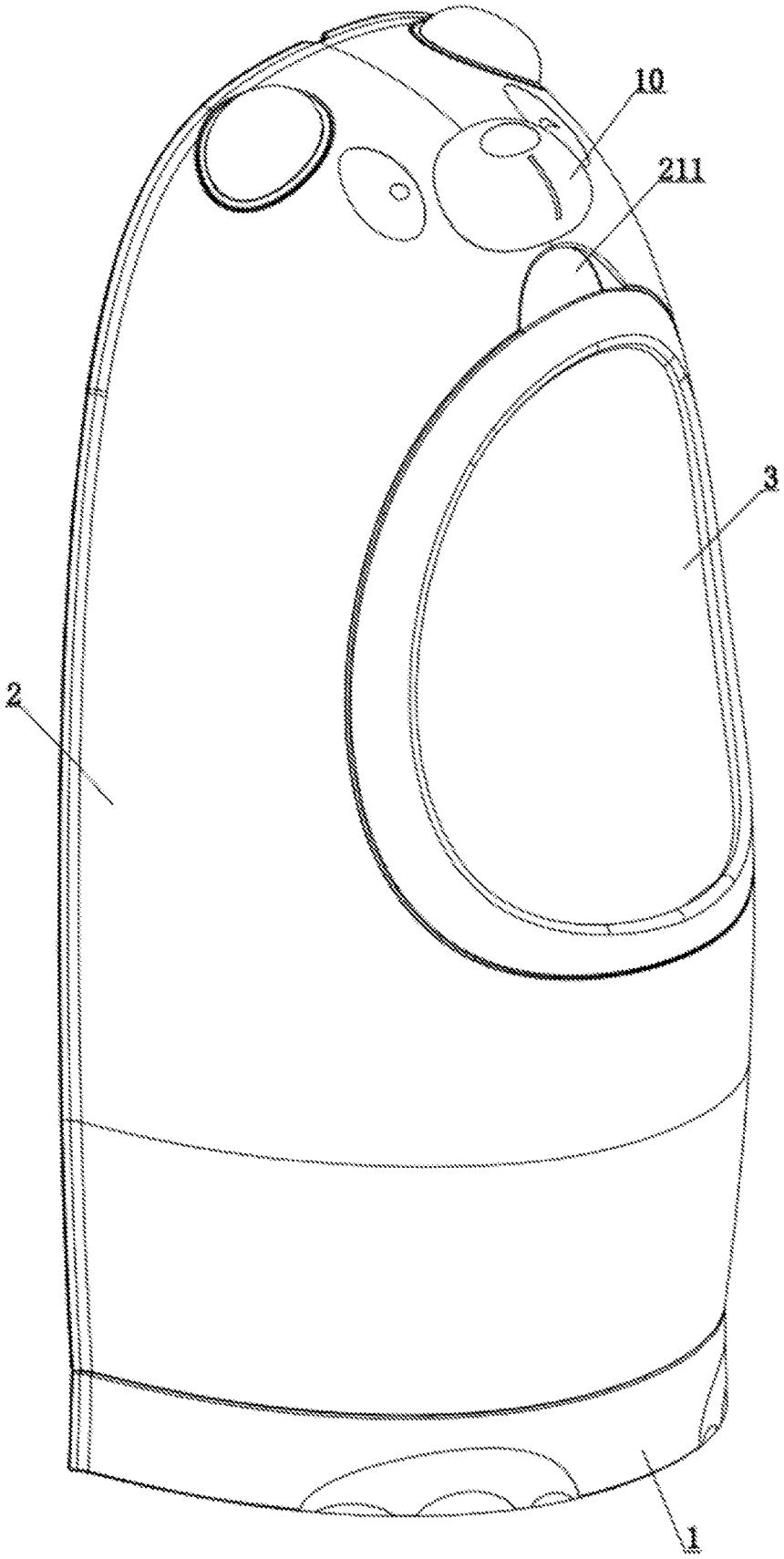
FIG. 1 is a structural diagram of the present invention.
Figure 2:
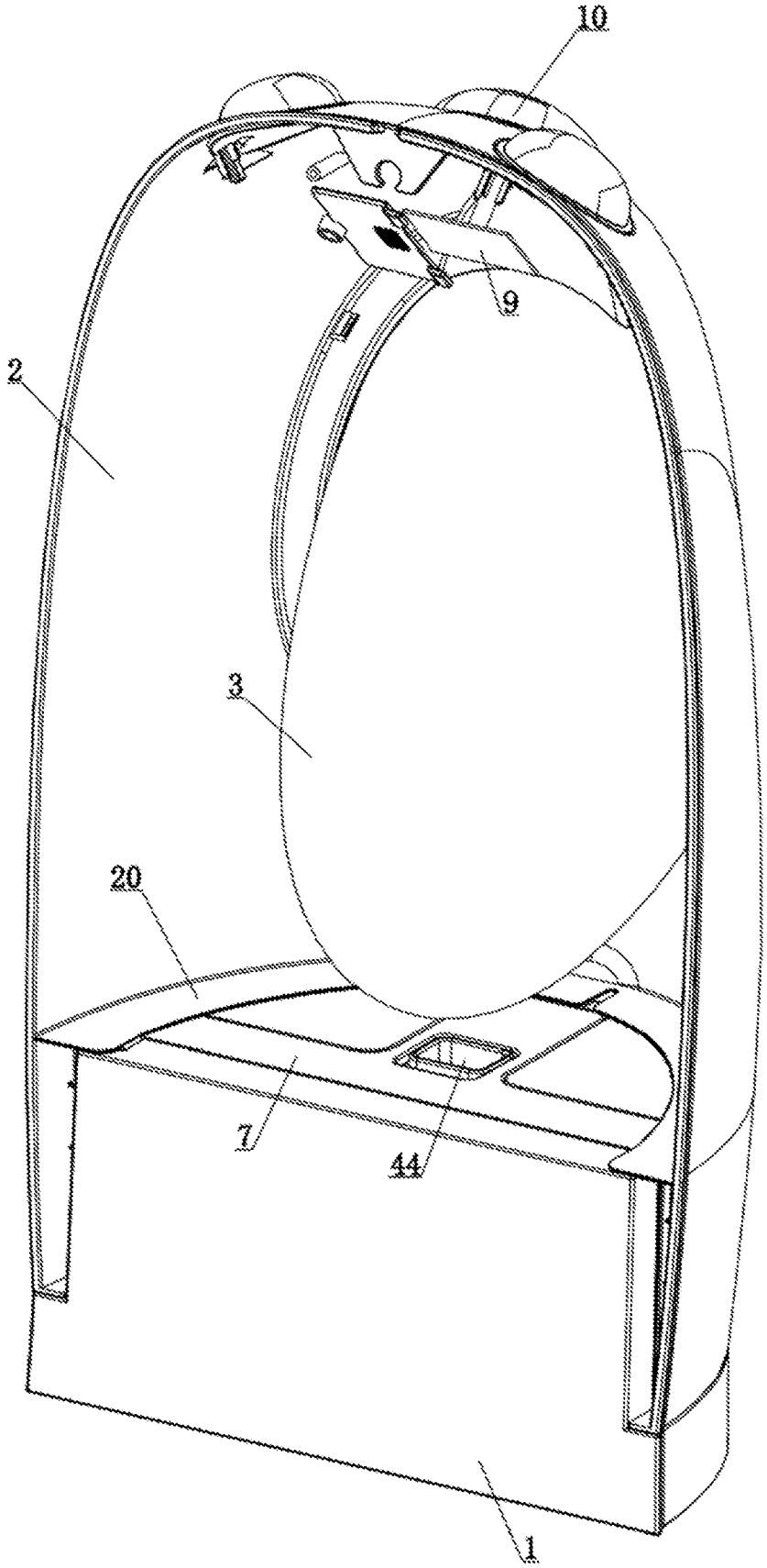
FIG. 2 is a structural diagram of the present invention from another angle.
Figure 3:
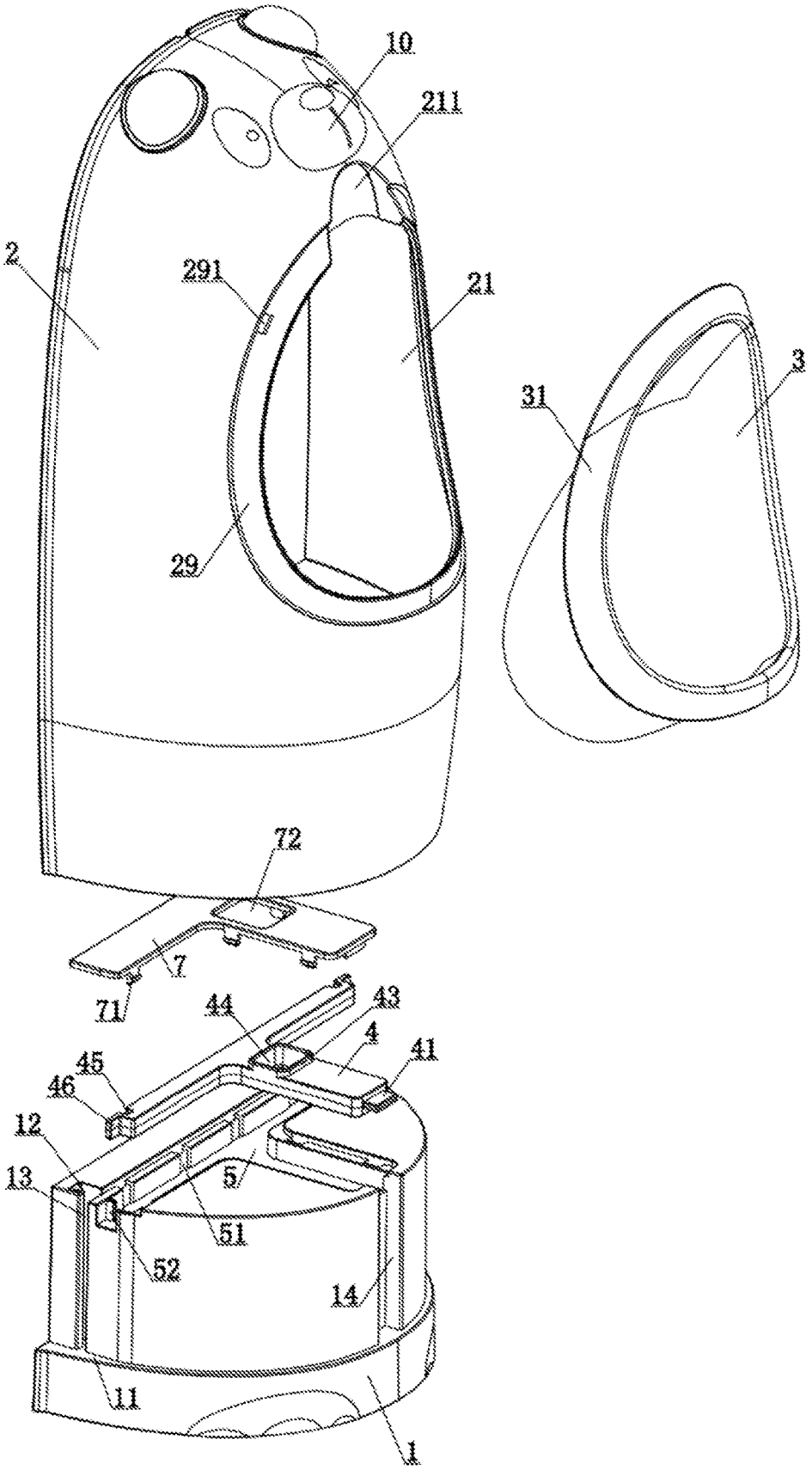
FIG. 3 is an exploded view of the structure of the present invention.

According to FIGS. 1 to 3, a multifunctional urinal for children includes a base 1, a pan seat 2 and a urinal pan 3. The pan seat 2 is set on the base 1 and can be lifted or lowered. The periphery of the base 1 is provided with a supporting edge 11. The bottom surface of the pan seat 2 can be located on the supporting edge 11. The front surface of the pan seat 2 is provided with a urinal pan opening 21, and the urinal pan 3 is detachably set on the urinal pan opening 21.

According to FIGS. 1 to 4, the left end and the right end of the base 1 are provided with post guiding slots 12. The left side and right side of the base 1 are provided with notches 13 communicating with the corresponding post guiding slots 12. The lower left portion and the lower right portion of the inner side of the pan seat 2 are both provided with a connecting piece 22. One side of the connecting piece 22 is provided with a guide post 23. The connecting piece 22 corresponds to a notch 13 and fits with the corresponding notch 13. The connecting piece 22 is located in the corresponding notch 13. The guide post 23 corresponds to a post guiding slot 12 and fits with the corresponding post guiding slot 12. The guide post 23 is located in the corresponding post guiding slot 12. The top surface of the base 1 is provided with an elastic pulling piece 4. The front end of the pulling piece 4 is provided with a clamping plate 41. The lower middle portion of the inner side of the pan seat 2 is provided with a plurality of clamping slots 24, which the clamping plate 41 can be inserted into and set at upper and lower intervals.

Figure 4:
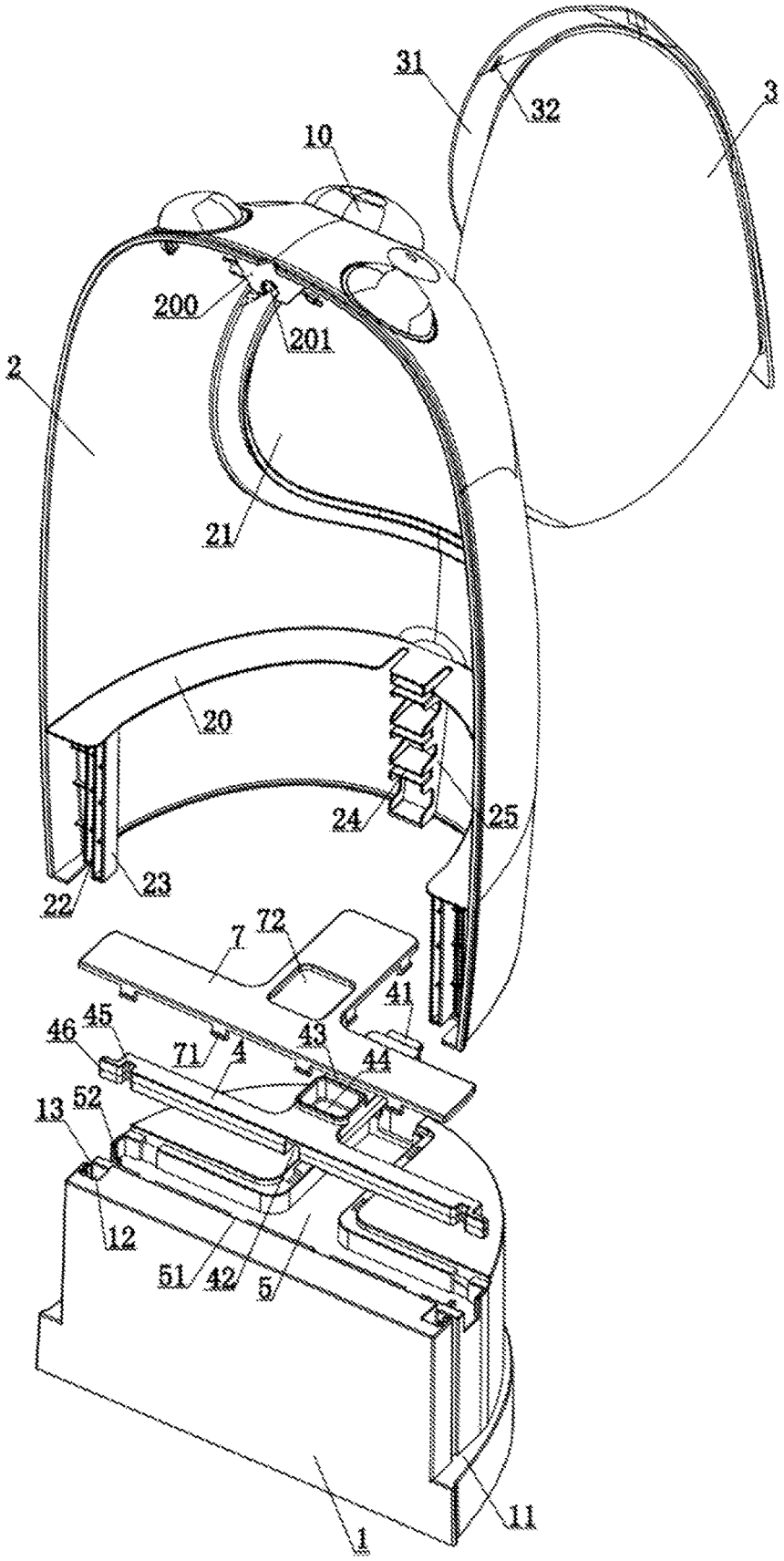
FIG. 4 is an exploded view of the structure of the present invention from another angle.
Figure 5:
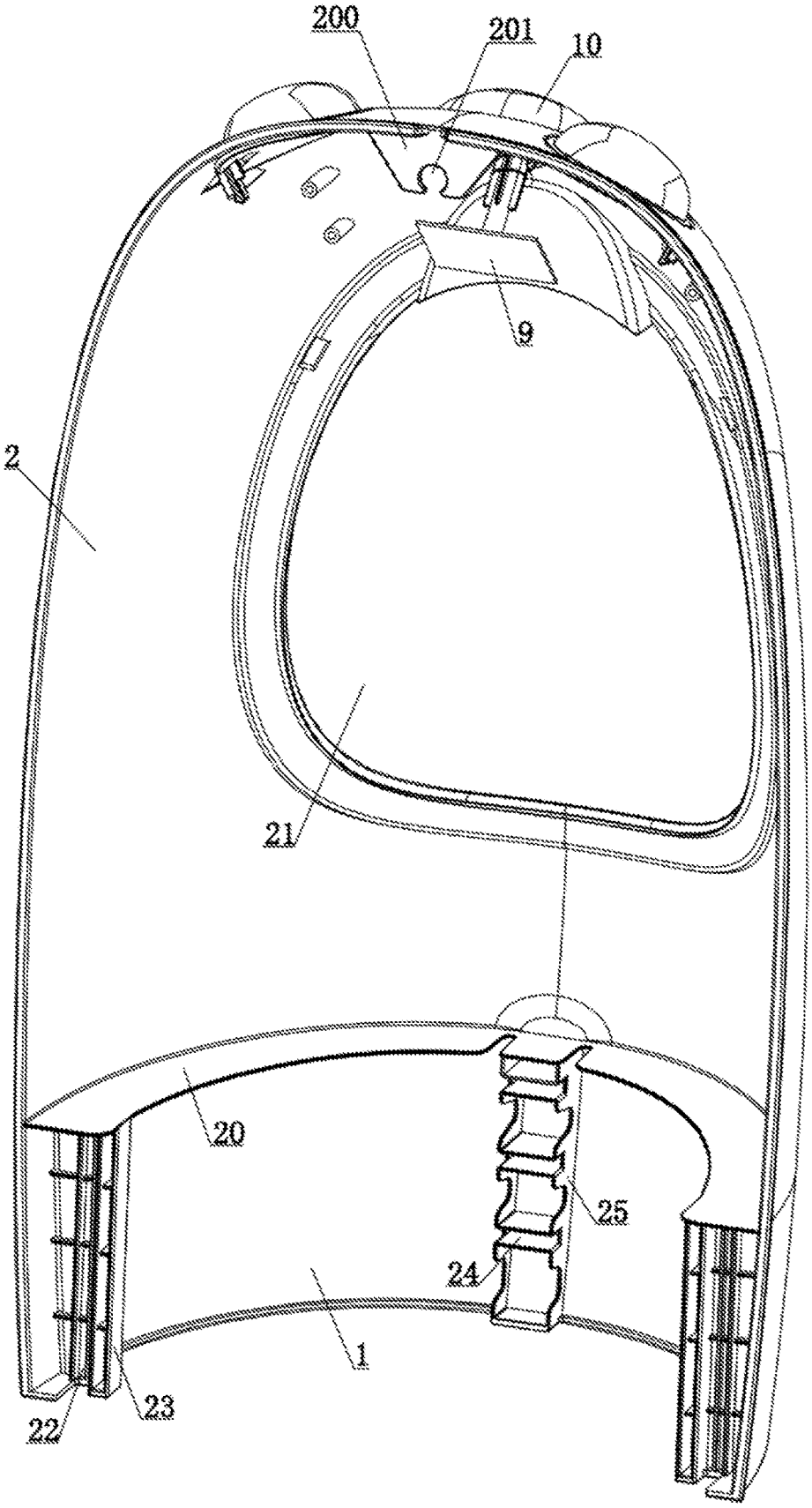
FIG. 5 is a structural diagram of the pan seat of the present invention.
Figure 6:
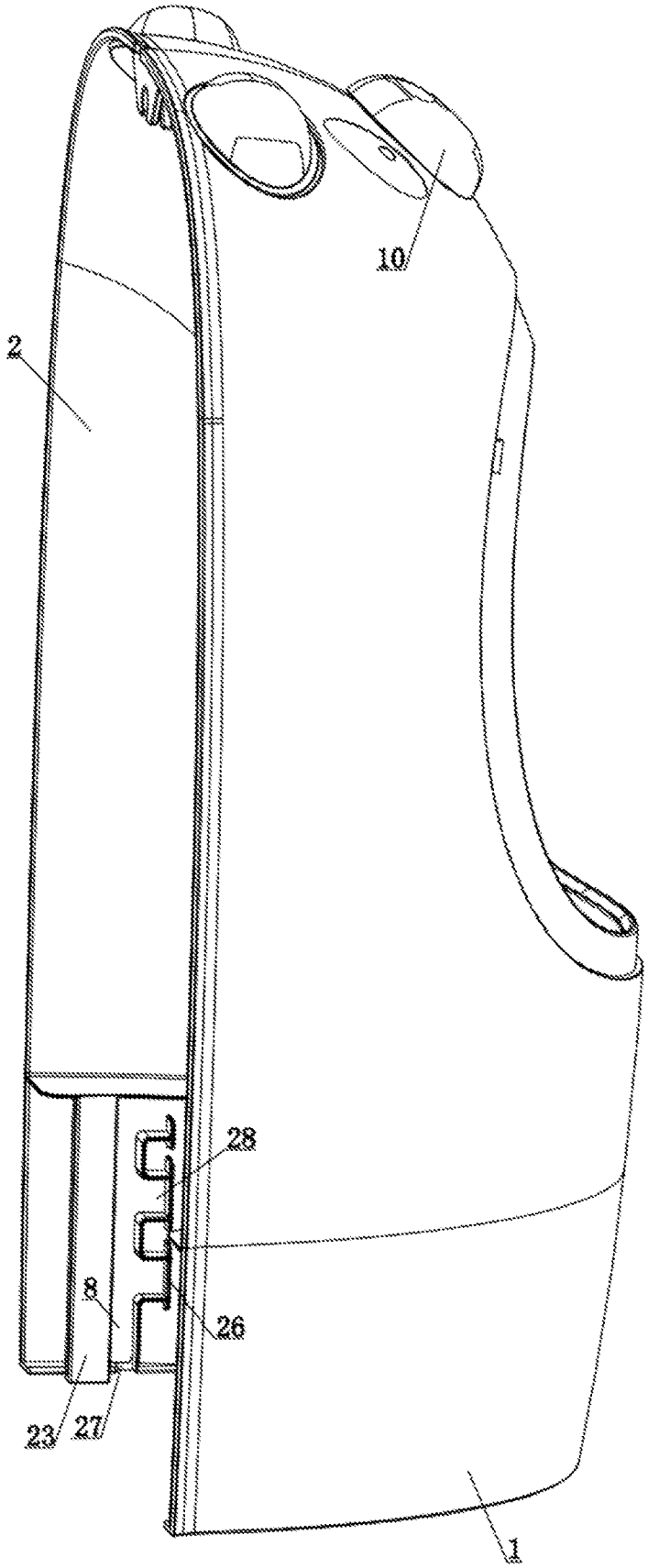
FIG. 6 is a structural diagram of the pan seat of the present invention from another angle.
Figure 7:
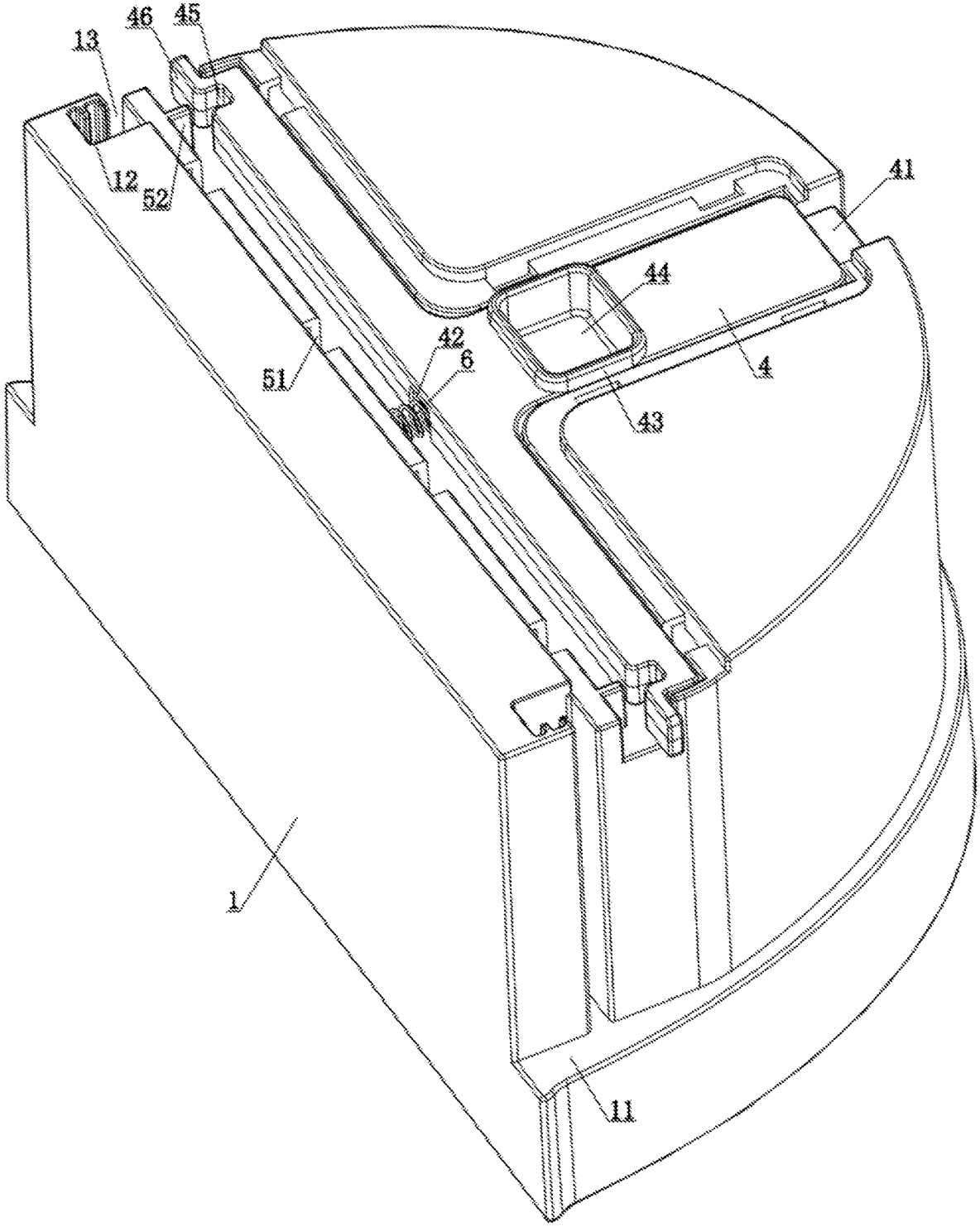
FIG. 7 is a structural diagram of the base of the present invention.

According to FIG. 3, FIG. 4 and FIG. 7. The top surface of the base 1 is provided with a T-shaped slot 5. The pulling piece 4 is T-shaped and located in the T-shaped slot 5. The middle portion of the transverse rear end surface of the pulling piece 4 is provided with a spring placement slot 42. A spring 6 is set between the spring placement slot 42 and the middle portion of the transverse rear side of the T-shaped slot 5. The clamping plate 41 is set at the front end of the pulling piece 4. A convex part 43 is set on the vertical top surface of the pulling piece 4. A groove 44 is set on the top surface of the convex part 43. A T-shaped fixing plate 7 is located on the top surface of the pulling piece 4. The bottom surface of the fixing plate 7 is provided with a plurality of hooks 71. The T-shaped slot 5 is provided with a plurality of hook slots 51 corresponding to the hooks 71. Each hook 71 corresponds to a hook slot 51 and can be hooked into the hook slot 51. The hook 71 is set to be a sheet shape and has a certain elasticity, which facilitates the disassembly and assembly of the fixing plate 7. A movable slot 72 is set on the vertical top surface of the fixing plate 7. The convex part 43 is located in the movable slot 72, and the length of the convex part 43 is less than the length of the movable slot 72. When the pulling piece 4 needs to be pulled, the user places finger in the groove 44 and pulls the pulling piece 4 backward. After the user releases the pulling piece 4, the pulling piece 4 is reset under the resilience of the spring 6.

According to FIG. 3, FIG. 4, FIG. 5 and FIG. 7, the lower middle portion of the inner side of the pan seat 2 is provided with a guide part 25. The middle portion of the front side of the base 1 is provided with a guide slot 14 matched with the guide part 25. The top of the guide slot 14 is connected to the front end of the T-shaped slot 5. The plurality of clamping slots 24 are located on the guide part 25. The clamping plate 41 is matched with the guide slot 14 and extends into the guide slot 14. The height of the guide part 25 and the height of the guide post 23 are equal. A limit plate 20 is set on the inner side of the pan seat 2, and the bottom surface of the limit plate 20 is located on the top surface of the guide part 25 and the guide post 23.

According to FIGS. 3 to 7, the left end and the right end of the transverse part of the pulling piece 4 are both provided with limit slots 45. Two limit pieces 52 are set on the transverse rear side of the T-shaped slot 5, and each limit piece 52 fits with a limit slot 45. Both the left end and the right end of the transverse part of the pulling piece 4 are provided with extending parts 46. A limit part 26 is provided both on the lower left portion and the lower right portion of the inner side of the pan seat 2. The limit part 26 is set on the front side of the corresponding connecting piece 22. A guide channel 8 is formed between the limit part 26 and the corresponding connecting piece 22. Two openings 27 are set on the bottom surface of the pan seat 2, and each opening 27 corresponds to a guide channel 8. The limit part 26 is provided with a plurality of extending part slots 28 set at upper and lower intervals. Each extending part 46 corresponds to a limit part 26. The extending part 46 can be located in the extending part slot 28.

According to FIGS. 3 to 7, when adjusting the height of the pan base 2, pull the pulling piece 4 to separate the clamping plate 41 from the original matching clamping slot 24, and the extending part 46 is separated from the original matching extending part slot 28. At the same time, the pan base 2 can be lifted and lowered. When the pan seat 2 is adjusted to a proper position, the pulling piece 4 is released so that the clamping plate 41 is set into the new clamping slot 24, and the extending part 46 is set into the new extending part slot 28 to fixedly connect the urinal pan 3 to the base 1. During the lifting and lowering adjustment process of the pan base 2, the guide post 23 is lifted and lowered along the corresponding post guiding slot 12, and the guide part 25 is lifted and lowered along the guide slot 14. When the height of the pan seat 2 is adjusted to be minimum, the bottom surface of the pan seat 2 is located on the supporting edge 11, and the limit plate 20 is located on the top surface of the base 1. When the pulling piece 4 is pulled back into place, the limit piece 52 is located in the corresponding limit slot 45.

According to FIG. 3 and FIG. 4, the urinal pan 3 is set obliquely backward and downward, and a clamping edge 31 is set on the front end of the urinal pan 3. The urinal pan opening 21 is provided with a clamping edge slot 29 for receiving the clamping edge, and a plurality of slots 291 are set on the clamping edge slot 29. A plurality of insert pieces 32 are set on the rear end of the clamping edge 31. Each insert piece 32 corresponds to a slot 291 and is inserted into the corresponding slot 291. A hand slot 211 is set on the middle portion of the top surface of the urinal pan opening 21. The urinal pan 3 can be directly sleeved on the urinal pan opening 21. When the urinal pan 3 is sleeved on the urinal pan opening 21, the insert piece 32 is inserted into the corresponding slot 291. The clamping edge 31 is clamped on the clamping edge slot 29. The hand slot 211 is convenient for the user to use the hands to reach in and take the urinal pan 3 out of the urinal pan opening 21, so as to facilitate pouring out of the urine. The urinal pan 3 is set obliquely backwards and downwards, so that the urinal pan 3 has a deeper space for accommodating urine to prevent the urine from splashing out when children urinate.

According to FIG. 2 and FIG. 4, the pan seat 2 is provided with an electrically connected trigger switch 9 and a music box (not shown in the figure). The pan seat 2 is provided with an elastic button 10, and the elastic button 10 can be located on the trigger switch 9. When finishing urinating, the child can press the elastic button 10, and the elastic button 10 drives the trigger switch 9 to play a sound of the music box (not shown in the figure). The music box (not shown in the figure) can play a simulated flushing sound. A suspension plate 200 is set in the middle of the rear end of the pan seat 2, and a suspension hole 201 is provided on the suspension plate 200. In addition to being placed on the ground, the urinal can also be suspended on the wall.

The above are only specific implementations of the present invention, but the design idea of the present invention is not limited to this. Any non-substantial modification of the present invention using this idea should fall into the protection scope of the present invention.

The invention claimed is:

1. A multifunctional urinal for children, comprising:

a base, wherein a periphery of the base includes a supporting edge;

a pan seat set on the base, wherein the pan seat is height adjustable by setting a clamping plate into one of a plurality of clamping slots, the supporting edge supports a bottom surface of the pan seat, and a front surface of the pan seat includes a urinal pan opening; and a urinal pan detachably set on the urinal pan opening;

a suspension plate is located in a middle of a rear end of the pan seat, and the suspension plate includes a suspension hole.

2. The multifunctional urinal of claim 1, wherein a left end and a right end of the base include post guiding slots, a left side and a right side of the base include notches correspondingly communicating with the post guiding slots, a lower left portion and a lower right portion of an inner side of the pan seat both include a connecting piece, one side of the connecting piece includes a guide post, the connecting piece corresponds to a notch and correspondingly fits with the notch, the connecting piece is located in the notch, the guide post corresponds to a post guiding slot and correspondingly fits with the post guiding slot, the guide post is located in the post guiding slot, a top surface of the base includes an elastic pulling piece, the clamping plate is located at a front end of the elastic pulling piece, the plurality of clamping slots are located at a lower middle portion of the inner side of the pan seat, and the clamping plate is configured for inserting into the plurality of clamping slots and set at upper and lower intervals.

3. The multifunctional urinal of claim 2, wherein the top surface of the base includes a T-shaped slot, the elastic pulling piece is T-shaped and located in the T-shaped slot, a middle portion of a transverse rear end surface of the elastic pulling piece includes a spring placement slot, a spring is located between the spring placement slot and a middle portion of a transverse rear side of the T-shaped slot, the clamping plate is located at the front end of the elastic pulling piece, a convex part is located on a vertical top surface of the elastic pulling piece, a groove is located on a top surface of the convex part, a T-shaped fixing plate is located on the top surface of the elastic pulling piece, a bottom surface of the T-shaped fixing plate includes a plurality of hooks, the T-shaped slot includes a plurality of hook slots corresponding to the plurality of hooks, each hook is hooked into a hook slot, a movable slot is located on a vertical top surface of the T-shaped fixing plate, the convex part is located in the movable slot, and a length of the convex part is less than a length of the movable slot.

4. The multifunctional urinal of claim 3, wherein the lower middle portion of the inner side of the pan seat includes a guide part, a middle portion of a front side of the base includes a guide slot matched with the guide part, a top of the guide slot is connected to a front end of the T-shaped slot, the plurality of clamping slots are located on the guide part, and the clamping plate is matched with the guide slot and extends into the guide slot.

5. The multifunctional urinal of claim 4, wherein a height of the guide part and a height of the guide post are equal, a limit plate is located on the inner side of the pan seat, and a bottom surface of the limit plate is located on the guide part and a top surface of the guide post.

6. The multifunctional urinal of claim 3, wherein a left end and a right end of a transverse part of the elastic pulling piece both include limit slots, two limit pieces are set on a transverse rear side of the T-shaped slot, each limit piece fits with a limit slot, extending parts are set on both the left end and the right end of the transverse part of the elastic pulling piece, limit parts are located both on the lower left portion and the lower right portion of the inner side of the pan seat, each limit part is located on a front side of the connecting piece, a guide channel is formed between the limit part and the connecting piece corresponding to the limit part, two openings are located on the bottom surface of the pan seat, each opening corresponds to a guide channel, the limit part includes a plurality of extending part slots set at upper and lower intervals, each extending part corresponds to a limit part, and the extending part is located in the extending part slot.

7. The multifunctional urinal of claim 1, wherein the urinal pan is located obliquely backward and downward, a clamping edge is located on a front end of the urinal pan, the urinal pan opening includes a clamping edge slot for receiving the clamping edge, a plurality of slots are located on the clamping edge slot, a plurality of insert pieces are located on a rear end of the clamping edge, each insert piece corresponds to a clamping edge slot and is corresponding inserted into one of the plurality of slots, and a hand slot is located on the middle portion of the top surface of the urinal pan opening.

8. The multifunctional urinal of claim 1, wherein the pan seat includes an electrically connected trigger switch and a music box, the pan seat includes an elastic button, and the elastic button is located on the electrically connected trigger switch.

9. A multifunctional urinal for children, comprising:

a base, wherein a periphery of the base includes a supporting edge;

a pan seat set on the base, wherein the pan seat is height adjustable by setting a clamping plate into one of a plurality of clamping slots, the supporting edge supports a bottom surface of the pan seat, and a front surface of the pan seat includes a urinal pan opening; and a urinal pan detachably set on the urinal pan opening; wherein the pan seat includes an electrically connected trigger switch and a music box, the pan seat includes an elastic button, and the elastic button is located on the electrically connected trigger switch.

10. The multifunctional urinal of claim 9, wherein a left end and a right end of the base include post guiding slots, a left side and a right side of the base include notches correspondingly communicating with the post guiding slots, a lower left portion and a lower right portion of an inner side of the pan seat both include a connecting piece, one side of the connecting piece includes a guide post, the connecting piece corresponds to a notch and correspondingly fits with the notch, the connecting piece is located in the notch, the guide post corresponds to a post guiding slot and correspondingly fits with the post guiding slot, the guide post is located in the post guiding slot, a top surface of the base includes an elastic pulling piece, the clamping plate is located at a front end of the elastic pulling piece, the plurality of clamping slots are located at a lower middle portion of the inner side of the pan seat, and the clamping plate is configured for inserting into the plurality of clamping slots and set at upper and lower intervals.

11. The multifunctional urinal of claim 10, wherein the top surface of the base includes a T-shaped slot, the elastic pulling piece is T-shaped and located in the T-shaped slot, a middle portion of a transverse rear end surface of the elastic pulling piece includes a spring placement slot, a spring is located between the spring placement slot and a middle portion of a transverse rear side of the T-shaped slot, the clamping plate is located at the front end of the elastic pulling piece, a convex part is located on a vertical top surface of the elastic pulling piece, a groove is located on a top surface of the convex part, a T-shaped fixing plate is located on the top surface of the elastic pulling piece, a bottom surface of the T-shaped fixing plate includes a plurality of hooks, the T-shaped slot includes a plurality of hook slots corresponding to the plurality of hooks, each hook is hooked into a hook slot, a movable slot is located on a vertical top surface of the T-shaped fixing plate, the convex part is located in the movable slot, and a length of the convex part is less than a length of the movable slot.

12. The multifunctional urinal of claim 11, wherein the lower middle portion of the inner side of the pan seat includes a guide part, a middle portion of a front side of the base includes a guide slot matched with the guide part, a top of the guide slot is connected to a front end of the T-shaped slot, the plurality of clamping slots are located on the guide part, and the clamping plate is matched with the guide slot and extends into the guide slot.

13. The multifunctional urinal of claim 12, wherein a height of the guide part and a height of the guide post are equal, a limit plate is located on the inner side of the pan seat, and a bottom surface of the limit plate is located on the guide part and a top surface of the guide post.

14. The multifunctional urinal of claim 11, wherein a left end and a right end of a transverse part of the elastic pulling piece both include limit slots, two limit pieces are set on a transverse rear side of the T-shaped slot, each limit piece fits with a limit slot, extending parts are set on both the left end and the right end of the transverse part of the elastic pulling piece, limit parts are located both on the lower left portion and the lower right portion of the inner side of the pan seat, each limit part is located on a front side of the connecting piece, a guide channel is formed between the limit part and the connecting piece corresponding to the limit part, two openings are located on the bottom surface of the pan seat, each opening corresponds to a guide channel, the limit part includes a plurality of extending part slots set at upper and lower intervals, each extending part corresponds to a limit part, and the extending part is located in the extending part slot.

15. A multifunctional urinal for children, comprising:

a base, wherein a periphery of the base includes a supporting edge;

a pan seat set on the base, wherein the pan seat is height adjustable by setting a clamping plate into one of a plurality of clamping slots, the supporting edge supports a bottom surface of the pan seat, and a front surface of the pan seat includes a urinal pan opening; and a urinal pan detachably set on the urinal pan opening; wherein the urinal pan is located obliquely backward and downward, a clamping edge is located on a front end of the urinal pan, the urinal pan opening includes a clamping edge slot for receiving the clamping edge, a plurality of slots are located on the clamping edge slot, a plurality of insert pieces are located on a rear end of the clamping edge, each insert piece corresponds to a clamping edge slot and is corresponding inserted into one of the plurality of slots, and a hand slot is located on the middle portion of the top surface of the urinal pan opening.

16. The multifunctional urinal of claim 15, wherein a left end and a right end of the base include post guiding slots, a left side and a right side of the base include notches correspondingly communicating with the post guiding slots, a lower left portion and a lower right portion of an inner side of the pan seat both include a connecting piece, one side of the connecting piece includes a guide post, the connecting piece corresponds to a notch and correspondingly fits with the notch, the connecting piece is located in the notch, the guide post corresponds to a post guiding slot and correspondingly fits with the post guiding slot, the guide post is located in the post guiding slot, a top surface of the base includes an elastic pulling piece, the clamping plate is located at a front end of the elastic pulling piece, the plurality of clamping slots are located at a lower middle portion of the inner side of the pan seat, and the clamping plate is configured for inserting into the plurality of clamping slots and set at upper and lower intervals.

17. The multifunctional urinal of claim 16, wherein the top surface of the base includes a T-shaped slot, the elastic pulling piece is T-shaped and located in the T-shaped slot, a middle portion of a transverse rear end surface of the elastic pulling piece includes a spring placement slot, a spring is located between the spring placement slot and a middle portion of a transverse rear side of the T-shaped slot, the clamping plate is located at the front end of the elastic pulling piece, a convex part is located on a vertical top surface of the elastic pulling piece, a groove is located on a top surface of the convex part, a T-shaped fixing plate is located on the top surface of the elastic pulling piece, a bottom surface of the T-shaped fixing plate includes a plurality of hooks, the T-shaped slot includes a plurality of hook slots corresponding to the plurality of hooks, each hook is hooked into a hook slot, a movable slot is located on a vertical top surface of the T-shaped fixing plate, the convex part is located in the movable slot, and a length of the convex part is less than a length of the movable slot.

18. The multifunctional urinal of claim 17, wherein the lower middle portion of the inner side of the pan seat includes a guide part, a middle portion of a front side of the base includes a guide slot matched with the guide part, a top of the guide slot is connected to a front end of the T-shaped slot, the plurality of clamping slots are located on the guide part, and the clamping plate is matched with the guide slot and extends into the guide slot.

19. The multifunctional urinal of claim 18, wherein a height of the guide part and a height of the guide post are equal, a limit plate is located on the inner side of the pan seat, and a bottom surface of the limit plate is located on the guide part and a top surface of the guide post.

* * * * *